United States Patent [19]

Nix

[11] 4,265,352

[45] May 5, 1981

[54] BEVERAGE CONTAINER RECEIVING AND STORING APPARATUS

[76] Inventor: Douglas E. Nix, 1117 N. 12th, Duncan, Okla. 73533

[21] Appl. No.: 29,313

[22] Filed: Apr. 12, 1979

[51] Int. Cl.[3] ..... G07F 7/06

[52] U.S. Cl. ..... 194/4 D

[58] Field of Search ..... 194/4 C, 4 D, 4 E, 4 R; 232/43.3, 43.1, 47–49

[56] References Cited

U.S. PATENT DOCUMENTS

| | | | |
|---|---|---|---|
| 830,231 | 9/1906 | Homme | 232/47 |
| 1,760,462 | 5/1930 | Yeo | 194/4 E |
| 2,992,717 | 7/1961 | Putman, Sr. | 194/4 C |
| 3,039,583 | 6/1962 | Menefee | 194/4 C |
| 3,343,638 | 9/1967 | Putman, Sr. | 194/4 C |
| 3,412,837 | 11/1968 | Myers | 194/4 |
| 3,976,345 | 8/1976 | Walters | 232/47 X |
| 4,054,196 | 10/1977 | Schaufele et al. | 194/4 C |

*Primary Examiner*—Stanley H. Tollberg

*Attorney, Agent, or Firm*—Laney, Dougherty, Hessin & Beavers

[57] ABSTRACT

The present invention provides an apparatus for receiving and storing a carton of beverage containers. The apparatus includes a compartment for receiving the carton, said compartment including a cover selectively movable between an open position and a closed position, so that when the cover is in the open position the carton may be placed in the compartment. An area for storing a plurality of cartons is provided. A mechanical holding device, operatively associated with the cover, retains each carton in the receiving compartment when the cover is in its open position, and releases said carton so that it may be moved to the storing area when the cover is in its closed position. A device for moving the carton from the receiving compartment to the storing area includes a gravity operated conveyor and an activator panel for initially urging the carton toward the storing area when the carton is released by the holding device. A receipt vending apparatus is operatively associated with the holding device for vending a receipt when the carton is moved to the storing area.

16 Claims, 16 Drawing Figures

BEVERAGE CONTAINER RECEIVING AND STORING APPARATUS

BACKGROUND OF THE INVENTION

1. Field of the Invention

This invention relates generally to apparatus for receiving articles, and more particularly, but not by way of limitation, to apparatus for receiving and storing a carton of empty beverage containers.

2. Description of the Prior Art

The present apparatus is designed for use in a supermarket for the collection of cartons of empty beverage containers.

Most beverage container receiving apparatus of the prior art, which are currently being used in all major supermarkets, merely consist of a large wire basket on wheels, which is generally placed at the front of the store. When a customer enters the supermarket they must either check their bottles with store personnel prior to depositing the bottles in the basket, or in some stores an honor system is used whereby the customer merely places the bottles in the empty bin and then informs the checkout clerk that he or she is entitled to a refund on the bottles.

The prior art includes a few attempts to automate this bottle receiving procedure so as to make it convenient for the customer, and at the same time to eliminate the need for using an honor system.

U.S. Pat. No. 2,992,717 to Putman Sr. shows a bottle receiving and storage apparatus having the same general purpose as the present invention. It is apparent, however, that the Putman Sr. apparatus is a highly complex one including a myriad of powered conveyors, electrical sensing switches, and electrical solenoids.

U.S. Pat. No. 4,054,196 to Schaufele et al discloses an apparatus for recieving and storing empty bottles. The Schaufele et al apparatus is so constructed that it may only receive one bottle at a time, and it also is a rather complex device having an electrically powered bottle conveyor system and utilizing many electrical sensing switches and the like. Similarly, U.S. Pat. No. 3,412,837 to Myers discloses a process and apparatus for the collection of metal containers. Against the Myers device is also very complex using a powered conveyor system and many electrical switches and the like.

Although it is apparent that the prior art has recognized the need for an apparatus for receiving and storing beverage containers, it is equally apparent that all of the previous attempts of constructing such an apparatus have involved highly complex, expensive, rather impractical devices insofar as their everyday use in the average supermarket is concerned.

The present invention, however, provides such a bottle receiving and storing apparatus which is entirely self-contained, operating only by the force of gravity and the actuation of various springs and levers, so that no electrical power is required and the apparatus is easily maintained and inexpensive to construct.

SUMMARY OF THE INVENTION

The present invention provides an apparatus for receiving and storing a carton of beverage containers. The apparatus includes a compartment for receiving the carton, said compartment including a cover means selectively movable between an open position and a closed position, so that when the cover means is in the open position the carton may be placed in the compartment. A means for storing a plurality of cartons is provided. A mechanical holding means, operatively associated with the cover means, retains each carton in the receiving compartment when the cover means is in its open position, and releases said carton so that it may be moved to the storing means when the cover means is in its closed position. A means for moving the carton from the receiving compartment to the storing means includes a gravity operated conveyor and a means for initially urging the carton toward the storing means when the carton is released by the holding means. A receipt vending means is operatively associated with the holding means for vending a receipt when the carton is moved to the storing means.

It is therefore an object of the present invention to provide an improved apparatus for receiving and storing cartons of empty beverage containers.

Another object of the present invention is the provision of a beverage container receiving apparatus which is entirely self-contained, operating only by the force of gravity and requiring no electrical or other power inputs.

A further object of the present invention is the provision of a bottle receiving apparatus which is economically constructed and easily maintained.

Other and further objects and advantages of the present invention will be evident from the following detailed description when read in conjunction with the accompanying drawings.

DETAILED DESCRIPTION OF THE PREFERRED EMBODIMENTS

The Overall Construction

Figure 1:
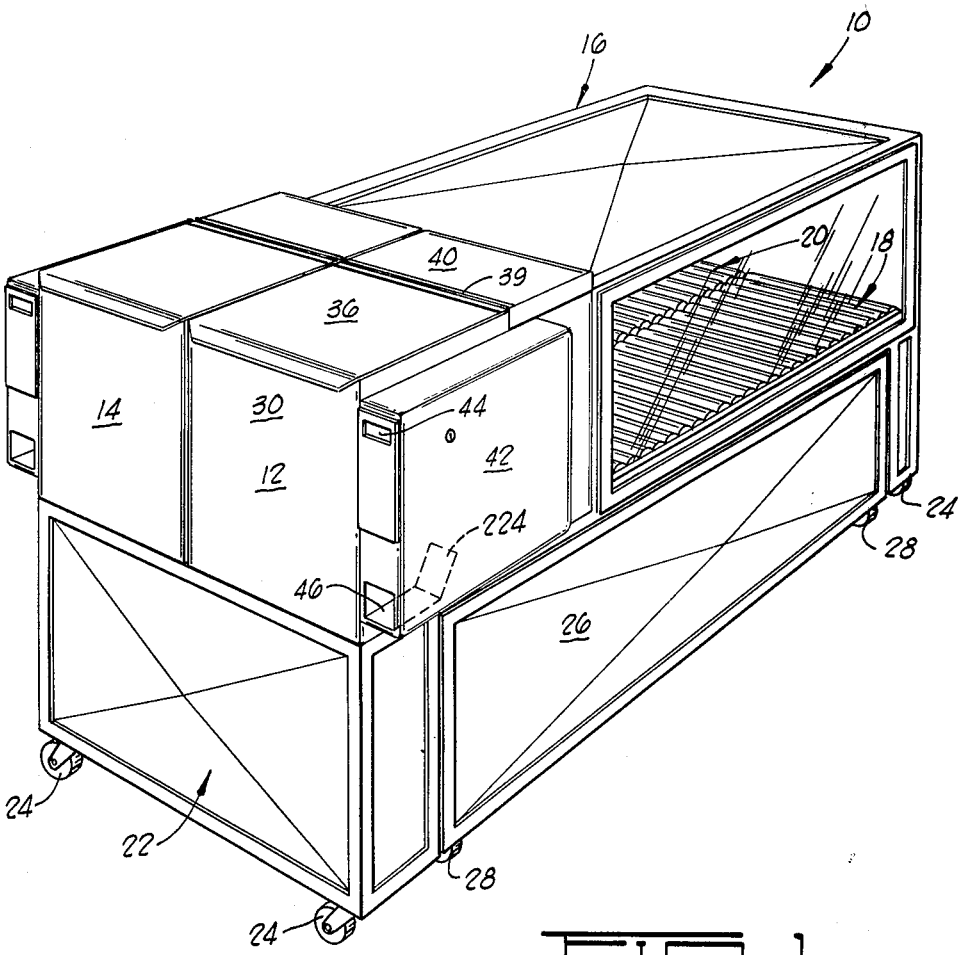
FIG. 1 is an oblique perspective view of the bottle receiving and storing apparatus of the present invention.

Referring now to the drawings and particularly to FIG. 1, the carton receiving and storing apparatus of the present invention is shown and generally designated by the numeral 10. The apparatus 10 includes first and second carton receiving heads 12 and 14, respectively. A carton storage section 16, which provides a means for storing a plurality of cartons, is connected to the rear end of the carton receiving heads 12 and 14. First and second gravity operated conveyors, 18 and 20, respectively, are located below the carton receiving heads 12 and 14 and the storage section 16, for moving cartons from the receiving heads 12 and 14 into the storage section 16. Conveyors 18 and 20 are sloped downward toward carton storage section 16.

The receiving heads 12 and 14, the storage section 16, and the conveyors 18 and 20 are supported from a frame 22. The frame 22 is in turn supported from a plurality of ground engaging wheels 24.

A removable carton container 26 is located within the frame 22 and is itself rollably supported on a plurality of wheels 28. The carton container 26 is merely an open topped parallel piped structure in which the cartons of the bottles may be placed for transportation from the apparatus 10 to another storage or disposal location. The removable carton container 26 may be moved out of engagement with the frame 22. When a door (not shown), formed in one of the sides of the carton storage section 16, is opened the cartons of bottles within the storage section 16 may be removed therefrom and placed in the carton container 26.

Figure 2:
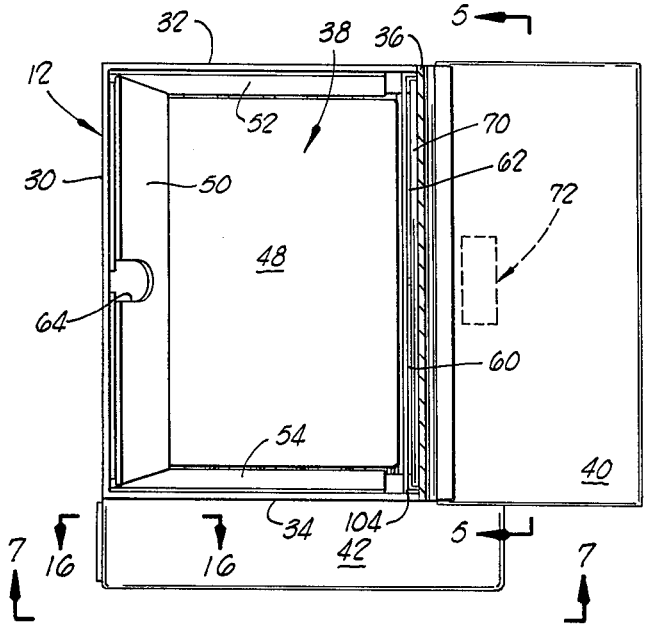
FIG. 2 is a plan view of the right hand bottle receiving compartment of FIG. 1, with the cover in the open position and shown in section. The compartment is empty and the actuating panel is in the unactuated position.

Referring now to FIG. 2, the first carton receiving head 12 includes a front side 30, inner and outer sides 32 and 34, respectively, and a movable top cover 36. FIG. 2 is a plan view of first carton receiving head 12, with top cover 36 open and shown in section. The sides 30, 32 and 34 and the cover 36 partially define a first carton receiving compartment 38. Cover 36 is connected to the remainder of compartment 38 by hinge 39.

The carton receiving compartment 38 is communicated to the carton storage section 16 through intermediate connecting section 40.

Attached to outer side 34 is a receipt vending means cover panel 42, which includes a compartment position indicator means 44 and a receipt dispensing opening 46.

Located below the top cover 36 is an actuator panel 48 which is shown in FIG. 2 in its unactuated substantially horizontal position. Actuator panel 48 is hingedly connected to front side 30, and provides a means for sensing the presence of a carton of bottles within compartment 38.

First, second and third guide panels 50, 52 and 54, respectively, are connected to the inside of front side 30, inner side 32 and outer side 34, respectively, for guiding a carton of bottles toward the center of the receiving compartment 38 when the carton is placed therein.

Figure 3:
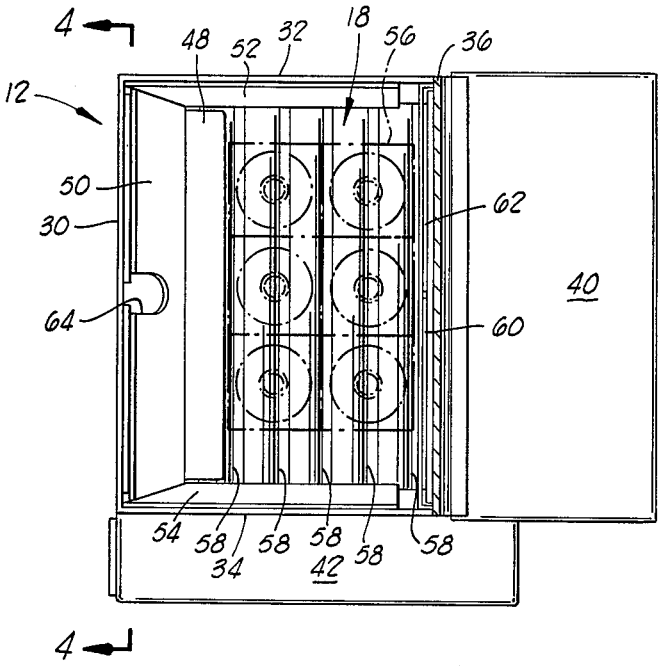
FIG. 3 is a view similar to FIG. 2 showing the actuating panel in the actuated position and illustrating the position of a carton of bottles in phantom lines.

When a carton of bottles 56 is placed in compartment 38, it engages actuator panel 48 and moves panel 48 from its unactuated horizontally oriented position of FIG. 2 to its actuated substantially vertical position shown in FIG. 3. When the carton 56 moves actuator panel 48 to its actuated position the carton 56 then passes on downward and rests upon the first conveyor 18. As is seen in FIG. 3 first conveyor 18 includes a plurality of conveyor rollers 58.

Figure 5:
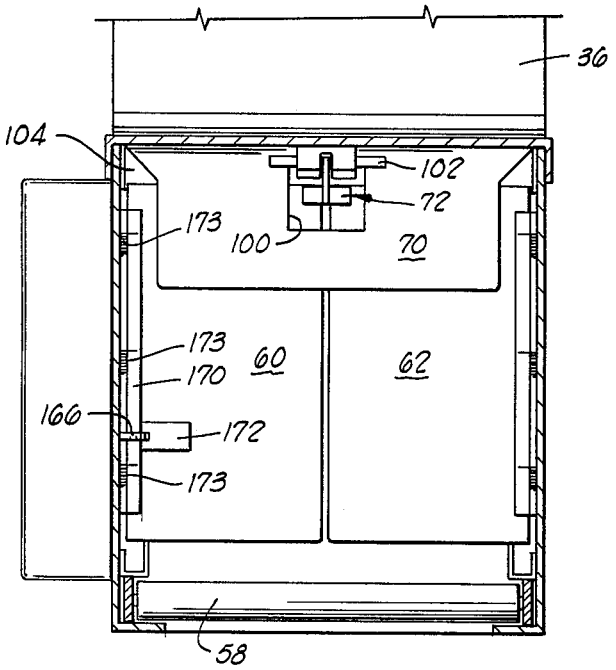
FIG. 5 is a sectional elevation view taken along lines 5—5 of FIG. 2 showing the holding doors in the closed position with the cover in the open position.

The carton 56 is retained in compartment 38 by a pair of swinging holding doors 60 and 62 which are best illustrated in their closed position spanning said conveyor 18 between compartment 38 and carton storage section 16 in FIG. 5.

Figure 4:
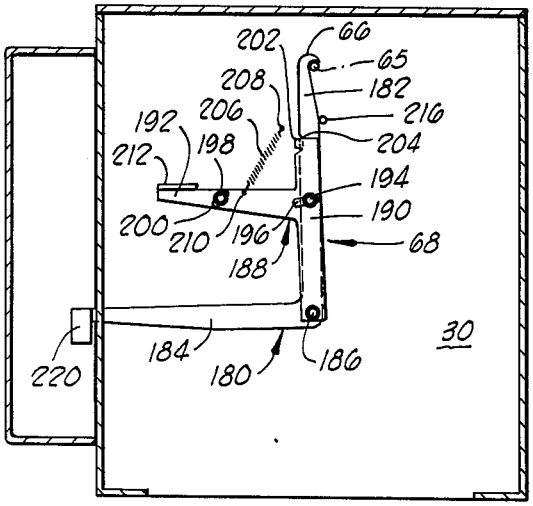
FIG. 4 is a sectional elevation view taken along lines 4—4 of FIG. 3 illustrating the front locking mechanism connected to the front side of the receiving compartment for locking the cover in the closed position.
Figure 8:
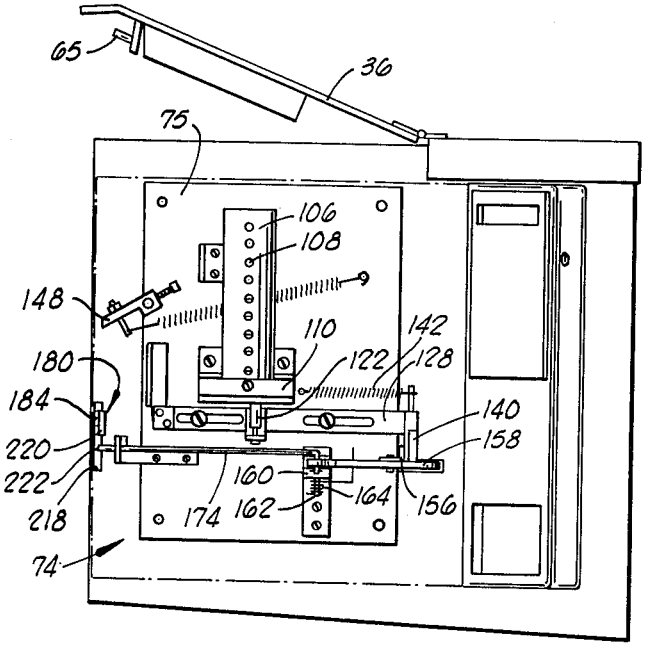
FIG. 8 is a view similar to FIG. 7 showing the receipt vending mechanism in its position just prior to vending a receipt, when the carton of bottles is in place in the receiving compartment.
Figure 11:
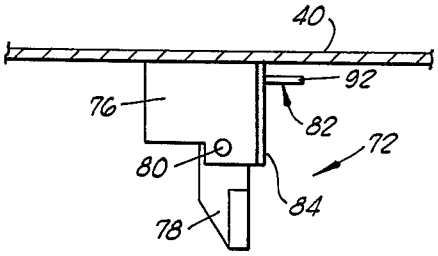
FIG. 11 is a side elevation view of the locking mechanism of FIG. 9.

First guide panel 50 includes a cut-out portion 44 which allows a latching pin 65, see FIG. 8, of top cover 36 to engage a latching hook 66 of front locking means 68, which is best seen in FIG. 4.

The top cover 36 is operatively related to the holding doors 60 and 62 through a rear lip portion 70 of top cover 36 and a rear locking means 72. Rear locking means 72 provides a means for preventing the holding doors 60 and 62 from opening when the top cover 36 is in the open position. When top cover 36 is closed sufficiently so that the latching pin 65 of top cover 32 may engage latching hook 66, the rear locking means 72 releases holding doors 60 and 62 so that they may open and allow the carton 56 to move down conveyor 18 into storage compartment 16.

Figure 7:
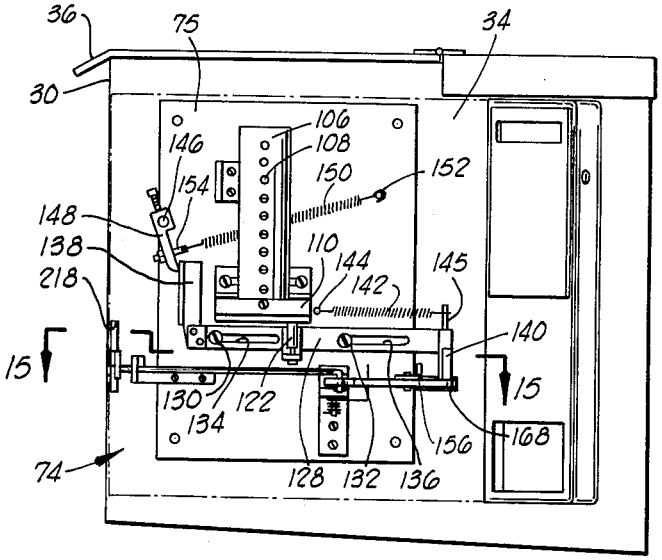
FIG. 7 is a side elevation view taken along lines 7—7 of FIG. 2 and having the receipt vending mechanism cover pivoted to its open position so that the receipt vending mechanism may be viewed. The receipt vending mechanism is shown in the position with the top cover closed and the bottle compartment empty.
Figure 9:
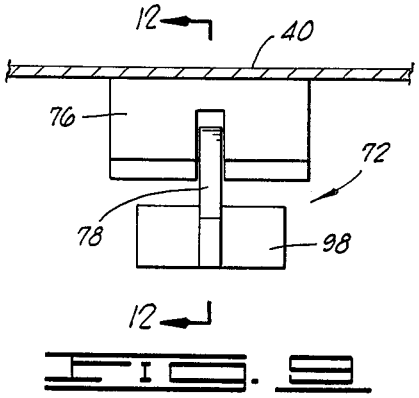
FIG. 9 is a rear elevation view of the rear locking mechanism for holding the holding doors in their closed position until the top cover is closed.
Figure 10:
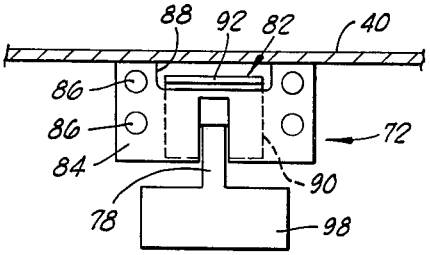
FIG. 10 is a front elevation view of the locking mechanism of FIG. 9.
Figure 15:
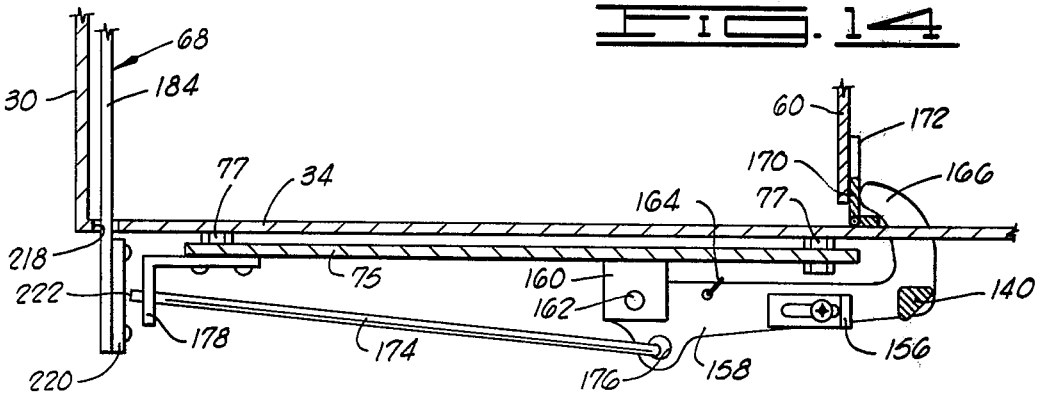
FIG. 15 is a sectional plan view taken along lines 15—15 of FIG. 7, illustrating the interlocking means between the holding doors and the front locking means.

The front locking means 68 and the holding door 60 are operatively associated through a receipt vending means 74 which is shown in FIGS. 7 and 8. Receipt vending means 74 is mounted upon mounting plate 75 which is in turn attached to outer side 34 by a plurality of fasteners 77, as best seen in FIG. 15. Holding door 60 and front latching means 68 are so associated that the front latching means 68 will not release top cover 36 if holding door 60 is in the open position.

The Rear Locking Means

The details of the rear locking means 72 are illustrated in FIGS. 9–12. Rear locking means 72 is a gravity operated locking means which includes a latch frame 76, a latching arm 78 which is pivotally connected to frame 76 by pivot pin 80, and a sliding latch key 82.

Latch frame 76 is fixedly attached to the underside of the top portion of intermediate connecting section 40. A back-up plate 84 is attached to latch frame 76 by a plurality of screws 86 so as to define a groove 87 between frame 76 and back-up plate 84. Back-up plate 84 includes a cut-out portion 88, seen in FIG. 10.

Sliding latch key 82 is an angular member having a vertical leg 90 and a horizontal leg 92. Vertical leg 90 is slidingly received within groove 87. Horizontal leg 92 protrudes through cut-out portion 88 of back-up plate 84.

Figure 12:
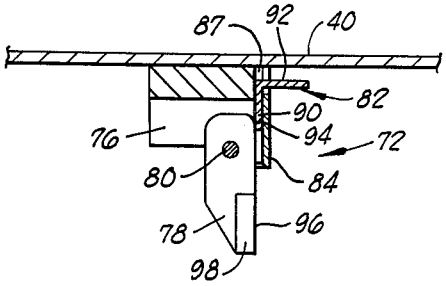
FIG. 12 is a side sectional elevation view of the locking mechanism of FIG. 9 taken along lines 12—12.

Sliding latch key 82 is slidable between a first latched position and a second unlatched position. Key 82 is shown in FIG. 12 in its first latched position. In the latched position of FIG. 12, the vertical leg 90 engages a rear upper shoulder 94 of latching arm 78, so that latching arm 78 is prevented from rotating in a clockwise direction about pivot pin 80 as seen in FIG. 12.

When the holding doors 60 and 62 are swung rearwardly towards their open position, they engage the rear surface 96 of crossbar 98 so that the holding doors 60 and 62 may not be opened when latch key 82 is in the latched position.

When the latch key 82 is slid upwardly to its unlatched position, the vertical leg 90 moves out of engagement with shoulder 94 so that latching arm 78 is free to rotate in either direction about pivot pin 80, thereby allowing holding doors 60 and 62 to move rearwardly past latching arm 78 to their open position.

Figure 6:
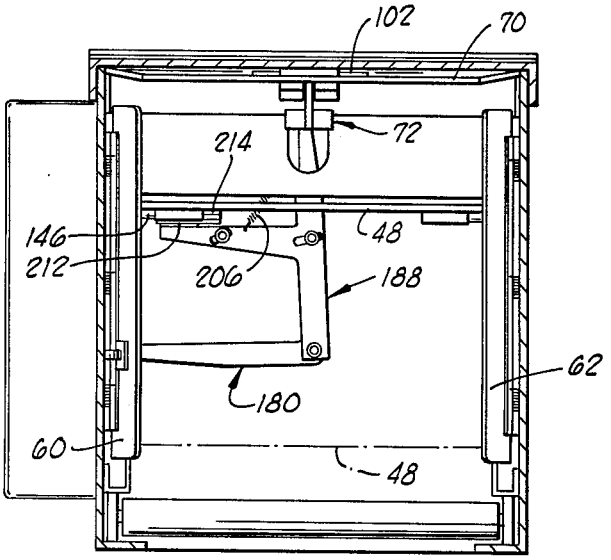
FIG. 6 is a view similar to FIG. 5 showing the cover in the closed position and the holding doors in the open position. The actuating panel is shown in the unactuated position in solid lines and in the actuated position in phantom lines.

Referring now to FIG. 5, the top cover 36 is shown in its open position so that the rear lip 70 is oriented in a vertical position. Rear lip 70 includes a rectangular cut-out 100 through which rear locking means 72 protrudes when cover 36 is in a closed position as shown in FIG. 6.

Extending across the upper end of rectangular cut-out 100 is a latch key engaging bar 102 which is attached to rear lip 70. Latch key engaging bar 102 is so oriented that when top cover 36 is in the closed position shown in FIG. 6, the engaging bar 102 engages horizontal leg 92 of sliding latch key 82 and moves it upwardly to the unlatched position so that holding doors 60 and 62 may be opened.

When top cover 36 is pivoted upwardly to its open position shown in FIG. 5, the latch key engaging bar 102 moves out of engagement with latch key 82 allowing it to drop downwardly due to the force of gravity to the lower latched position shown in FIG. 12.

The top cover, front locking means 68, and rear locking means 72 are so constructed that the engaging bar 102 does not move latch key 82 to the unlatched position until top cover 36 is closed a sufficient amount to allow the front locking mechanism 68 to be locked, so that the holding doors 60 and 62 may not be opened until the top cover 36 is itself latched in the closed position.

The respective orientation of the top cover 36, the holding doors 60 and 62, and the rear latching means 72, relative to each other can best be understood by viewing FIGS. 2 and 5, which both show the top cover 36 in the open vertical position. As is seen in FIG. 2, when the top cover 36 is in the open vertical position, the rear lip 70 of cover 36, which is slightly offset from the plane of cover 36, engages holding doors 60 and 62 urging them in a forward direction. The holding doors 60 and 62 are, however, prevented from opening in a forward direction by their engagement with metal strap 104 which spans inner and outer sides 32 and 34.

As top cover 36 is lowered toward its closed position, holding doors 60 and 62 are allowed to pivot rearwardly into engagement with crossbar 98 of rear locking means 72. The rear locking means 72, however, remains in the latched position preventing holding doors 60 and 62 from opening until top cover 36 is almost completely shut at which point engaging bar 102 engages sliding latch key 82 moving it upwards to unlatch rear locking means 72 thereby permitting holding doors 60 and 62 to open.

Receipt Vending Mechanism

Referring now to FIGS. 7 and 8, the structure and operation of the receipt vending mechanism 74 will be described. FIG. 7 illustrates the position of receipt vending mechanism 74 when compartment 38 is empty and actuator panel 48 is in the unactuated substantially horizontal position of FIG. 2. FIG. 8 illustrates the position of receipt vending mechanism 74 when a carton 56 is in place within compartment 38 and actuator panel 48 is in the actuated substantially vertical position of FIG. 3.

Receipt vending mechanism 74 includes a vertically oriented token storage tube 106. Token storage tube 106 includes a plurality of apertures 108 through which the level of the stack of tokens 109 within the tube 106 may be visualized. The tokens 109 in the tube 106 are plastic disc-shaped tokens about the size of a poker chip.

Connected to the bottom of token storage tube 106 is a token dispensing means 110. The token dispensing means 110 is further illustrated in FIGS. 13 and 14.

Figure 13:
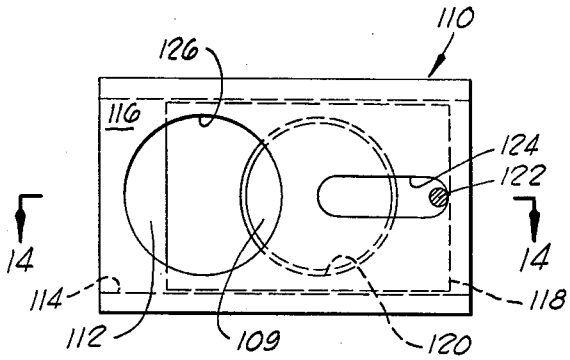
FIG. 13 is a bottom view of the token dispensing means portion of the receipt vending means of FIG. 7.
Figure 14:
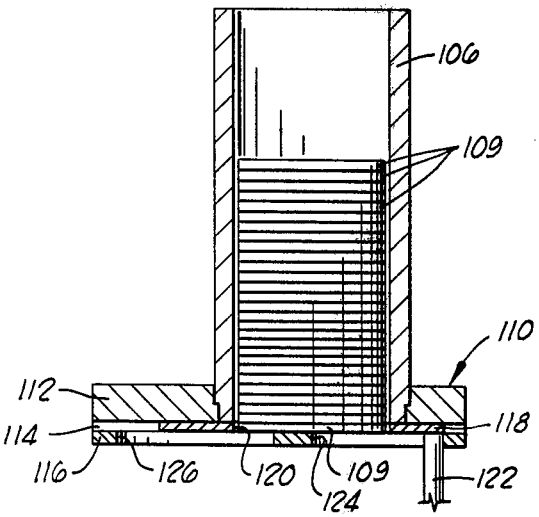
FIG. 14 is a sectional elevation view of the token dispensing means of FIG. 13 taken along lines 14—14.

FIG. 13 is a bottom view of token dispensing means 110. FIG. 14 is a sectional elevation view taken along line 14—14 of FIG. 13.

Token dispensing means 110 includes an upper body 112 made from a thick rectangular metal plate. Body 112 has a groove 114 in the bottom thereof. A lower plate 116 is attached to the bottom of body 112.

Received within groove 114 between lower plate 116 and body 112 is a sliding token ejection plate 118. Token ejection plate 118 includes a circular cut-out 120 for receiving a token 109 from token storage tube 106.

A vertically downward extending pin 122 is connected to plate 118 and protrudes through a slot 124 of lower plate 116.

By means of the pin 122, the sliding token ejection plate 118 may be reciprocated within groove 114 between a first position, illustrated in FIGS. 13 and 14, with the cut-out 120 in registry with storage tube 106, and a second position where ejection plate 118 has been moved forward so that cut-out 120 is in registry with a circular cut-out 126 of lower plate 116. When the ejection plate 118 is in its second position, the token 109 falls through cut-out 126 of lower plate 116, i.e. it is ejected.

Referring again to FIG. 7, the pin 122 is connected to ejection actuator bar 128 which reciprocates upon pins 130 and 132 which are attached to mounting plate 75 and which protrude through slots 134 and 136, respectively, of ejection actuator bar 128.

Attached to ejection actuator bar 128 are a front vertically upward projecting leg 138 and a rear vertically downward projecting leg 140.

A first spring means 142 is connected between a pin 144, attached to mounting plate 75 and a pin 145 projecting upwardly from ejection actuator bar 128, so as to resiliently urge ejection actuator bar 128 forward towards front side 30.

The actuator panel 48 located in compartment 38, as seen in FIGS. 2 and 3, is attached to an actuator panel pivot bar 146 so as to pivot therewith. Attached to actuator panel pivot bar 146 is actuator panel arm 148 which also pivots with bar 146 and panel 48. A second resilient spring means 150 is connected between a pin 152, attached to mounting plate 75, and a pin 154 connected to arm 148, so that actuator panel pivot bar 146 is resiliently urged to rotate in a counterclockwise direction as viewed in FIG. 7.

When actuator panel 48 is in its horizontal unactuated position, i.e., when there is not a carton 56 within the compartment 38, the actuator panel arm 148 is in the position shown in FIG. 7 with its lower end engaging front leg 138 of ejection actuator bar 128. The force exerted by second spring means 150, relative to first spring means 142, is such that ejection actuator bar 128 is moved rearward to its first position, as shown in FIG. 7, with circular cut-out 120 of sliding token ejection plate 118 in registry with token storage tube 106, as shown in FIGS. 13 and 14, so that a token 109 may move from token storage tube 106 into the cavity defined by circular cut-out 120.

The operation of receipt vending means 74 when a carton 56 is placed within compartment 38 is as follows. The top cover 36 is raised and the carton 56 is placed within compartment 38 as shown in FIG. 3. When the carton 56 is placed within compartment 38, it engages actuator panel 48 and pivots it from its horizontally oriented position as shown in FIG. 2, to its substantially vertically oriented position as shown in FIG. 3, and simultaneously the actuator panel arm 148 pivots clockwise, as seen in FIG. 8, to the position of FIG. 8, thereby moving out of engagement with front vertical leg 138 of ejection actuator bar 128, and allowing ejection actuator bar 128 to be moved forward by the resilient force of first spring 142. Ejection actuator bar 128 moves forward until rear vertical leg 140 engages a stop bracket 156, which holds ejection actuator bar 128 and sliding token ejection plate 118 at an intermediate position just short of their second position, so that circular cut-out 120 of token ejection plate 118 is held just short of being in registry with circular cut-out 126 of lower plate 116 and the token 109 cannot be ejected from token dispensing means 110.

Stop bracket 156 is adjustably attached to a swing arm 158 which is pivotally connected to mounting plate 75 through bracket 160 and pivot pin 162. A spring 164 is disposed about pivot pin 162 and engages mounting bracket 160 and swing arm 158 so that swing arm 158 is resiliently urged to pivot in a counterclockwise direction about pivot pin 162 as viewed in FIG. 15.

Swing arm 158 includes a finger 166 which protrudes through a slot 168 through outer side wall 34 and engages holding door 60.

When holding door 60 is swung open to the rear it pushes against finger 166 and causes swing arm 158 to rotate in a clockwise direction about pivot pin 162 as seen in FIG. 15. This moves stop bracket 156 out of engagement with rear vertical leg 140 and allows first resilient spring 142 to move ejection actuator bar 128 and token ejection plate 118 forward to their second position so that circular cut-out 120 is in registry with circular cut-out 126 thereby allowing token 109 to fall through circular cut-out 126 and be ejected.

Finger 166 actually engages a piano hinge 170 and a nonmetallic wear plate 172. The door 60 is mounted on piano hinge 170 which is in turn attached to outer side 34. The wear plate 172 is attached to holding door 60. A plurality of coil springs 173, see FIG. 5, are attached to piano hinge 170 in a conventional manner so as to urge holding door 60 towards its closed position. Holding door 62 is similarly mounted on inner side 32.

An interlock rod 174 is pivotally attached to swing arm 158 by the protrusion of the rear end of rod 174 through hole 176 in swing arm 158. The forward end of rod 174 is disposed through an opening (not shown) in a guide bracket 178 which is attached to mounting plate 75. A functional equivalent of spring 164 may be provided by a small compression spring between rod 174 and bracket 178.

Front Latching Mechanism

Referring to FIG. 4, the front latching mechanism 68 includes a primary member 180 having a vertical leg 182 and a horizontal leg 184. Primary member 180 is pivotally attached to front side 30 by pivot pin 186. A secondary member 188 is also pivotally attached to front side 30 at pivot pin 186, and includes a vertical leg 190 and a horizontal leg 192. Primary and secondary members 180 and 188 are each pivotable between a first position, illustrated in FIG. 4, with hook 66 engaging latching pin 65, and a second position, pivoted slightly counterclockwise from that of FIG. 4, with hook 66 moved aside so that it cannot engage pin 65.

A guide pin 194 is attached to front side 30 and protrudes through a slot (not shown) in vertical leg 182 of first member 180 and a slot 196 in vertical leg 190 of second member 188. A second guide pin 198 is also attached to front side 30 and protrudes through a slot 200 in horizontal leg 192.

The connection of primary and secondary members 180 and 188 to pivot pin 186 is such that secondary member 188 may pivot relative to primary member 180. Clockwise pivotal movement, as seen in FIG. 4, of secondary member 188 relative to primary member 180 is, however, limited by engagement of a tab 202 at the upper end of vertical leg 190 of secondary member 188 with a notch 204 in vertical leg 182 of primary member 180. Tab 202 protrudes forward from vertical leg 190. A resilient spring member 206 is connected between an anchor in 208 attached to front side 30 and a pin 210 attached to horizontal leg 192 so that secondary member 188 is resiliently urged to pivot in a clockwise direction about pivot pin 186 as viewed in FIG. 4.

Attached to the outer end of horizontal arm 192 is a horizontally oriented plate 212. As is best seen in FIG. 6, the plate 212 engages a stack of shims 214 which are attached to actuator panel 48 forward of actuator panel pivot bar 146.

When actuator panel 48 is in the horizontally oriented position shown in solid lines in FIG. 6, the shims 214 are in their lowest position and they have engaged plate 212 and caused secondary member 188 to pivot in a counterclockwise direction about pivot pin 186.

The force of gravity acting upon horizontal arm 184 of primary member 180 causes primary member 180 to also pivot counterclockwise about pivot pin 186 when it is free to do so.

When actuator panel 48 is pivoted downward to the substantially vertical position illustrated in phantom lines in FIG. 6, the shims 214 are moved upward out of engagement with plate 212, and spring 206 then causes secondary member 188 to pivot clockwise about pivot pin 186. Tab 202 engages primary member 180 and also causes it to pivot clockwise about pivot pin 186. The clockwise motion of primary and secondary members 180 and 188 is limited by engagement of vertical leg 182 with limit pin 216 which is attached to front side 30.

Manner of Operation

The operation of front locking mechanism 68 and its inter-relation with top cover 36, rear locking means 72, receipt vending means 74 will now be described. This description begins with the apparatus in the position illustrated in FIG. 7. The top cover 36 is closed, the actuator panel 48 is in its horizontally oriented position, as shown in FIG. 2, and the compartment 38 is empty. The holding doors 60 and 62 are closed. The circular cut-out 120 of token ejection plate 118 is in its first position in registry with token storage tube 106 so that a token 109 is received in the cavity defined by cut-out 120. The shims 214 are in engagement with plate 212 so that secondary member 188 has been pivoted counterclockwise and primary member 180 has similarly been pivoted counterclockwise by the force of gravity acting on arm 184. The hook 66 is in its second non-locking position so that it is not in contact with the locking pin 65 of top cover 36 (i.e., the primary and secondary members 180 and 188 are pivoted slightly counterclockwise from the position shown in FIG. 4).

The top 36 may be opened, since front locking mechanism 68 is unlocked. When a carton 56 is placed in compartment 38 it engages actuator panel 48 and pivots it to its actuated substantially vertically oriented position. When actuator panel 48 is so pivoted, the shims 214 are moved upward out of engagement with plate 212 so that secondary member 188 and primary member 180 are pivoted clockwise by the force from spring 206, to the position shown in FIG. 4. The hook 66 is in a position directly below the locking pin 65 of top cover 36 so that hook 66 is said to be in the locking position. Top cover 36, however, is still in the open position so that it is not locked into front locking mechanism 68.

After the carton 56 has been placed in compartment 36, so that it rests upon conveyor 18, the top cover 36 is then lowered towards its closed position. It is noted that the rear latching mechanism 72 prevents holding doors 60 and 62 from opening until top cover 36 is sufficiently lowered to be locked by front locking mechanism 68. When the latching pin 65 of top cover 36 engages hook 66, primary member 188 is caused to pivot slightly counterclockwise until the latching pin 65 of top cover 36 moves below hook 66 and then hook 66 snaps, i.e., primary member rotates back clockwise, so that hook 66 is above the latching pin 65 of top cover 36 and top cover 36 is therefore locked in the closed position. The position of latching pin 65 when cover 36 is locked in the closed position is shown in phantom lines in FIG. 4.

When the actuator panel 48 was moved to its vertically oriented position, the actuator panel arm 148 was rotated to the position illustrated in FIG. 8 so that ejection actuator bar 128 moved forward to its intermediate position with the rear leg 140 thereof engaging stop bracket 156, thereby holding a token 109 just short of being ejected.

When the top cover 36 is locked in its closed position by front latching mechanism 68, the rear latching mechanism 72 releases holding doors 60 and 62 so that they may open. The spring 150 connected to actuator panel arm 148 then causes actuator panel arm 148 to rotate back in a counterclockwise direction as seen in FIG. 8 and concurrently the actuator panel 48 pivots upward toward its horizontally oriented position. As the actuator panel 48 pivots upward, it pushes the carton 56 through the holding doors 60 and 62 causing the holding doors to swing open in a rearward direction. The conveyor 18 is sloped downward to the rear so that the initial urging in a rearward direction provided by actuator panel 48 overcomes any static friction and starts carton 56 rolling down conveyor 18. Carton 56 rolls through holding doors 60 and 62 into carton storage section 16.

As holding door 60 opens it pushes finger 166 outward thereby pivoting swing arm 158 and moving stop bracket 156 out of engagement with rear leg 140, thereby allowing ejection actuator bar 128 to move forward to its second position so that circular cut-out 120 of token ejector plate 118 is in registry with circular cut-out 126 so that the token 109 may be ejected.

The horizontal arm 184 of primary member 180 protrudes through a slot 218 in outer side 34 and has a blocking plate 220 attached to its outer end.

When the top cover 36 is closed and locked in the closed position by front latching mechanism 68 the horizontal arm 184 and blocking plate 220 are in the position illustrated in FIG. 8, so that blocking plate 220 is located above interlock rod 174. When holding door 60 is in the open position the swing arm 158 is rotated so that interlock rod 174 moves forward so that its forwardmost end 222 is located below blocking plate 220.

When the actuator panel 48 is returned to its horizontal position, the shims 214 once again engage plate 212 and move secondary member 188 counterclockwise. The holding doors 60 and 62, however, remain open for a short period of time after actuator panel 48 has returned to the horizontal position, because the carton 56 must move a distance past hinge 170 before the doors 60 and 62 can close.

While the holding doors 60 and 62 are still open the interlock rod 174 remains in a position directly below blocking plate 220 so that primary member 180 is prevented from rotating counterclockwise due to the force of gravity, and therefore the top cover 36 remains locked in the closed position so long as the holding door 60 is open.

Once the carton 56 has moved completely past holding doors 60 and 62, the holding doors are returned to their closed position by springs 173 and the finger 166 is also moved inward due to the force of spring 164, thereby moving interlock rod 174 rearward and allowing primary member 180 to be rotated counterclockwise due to the force of gravity acting on horizontal arm 184, thereby unlocking front locking means 68 so that top cover 36 is once again free to open. The cycle has now been completed and the carton receiving head 12 is ready to receive another carton of bottles.

Figure 16:
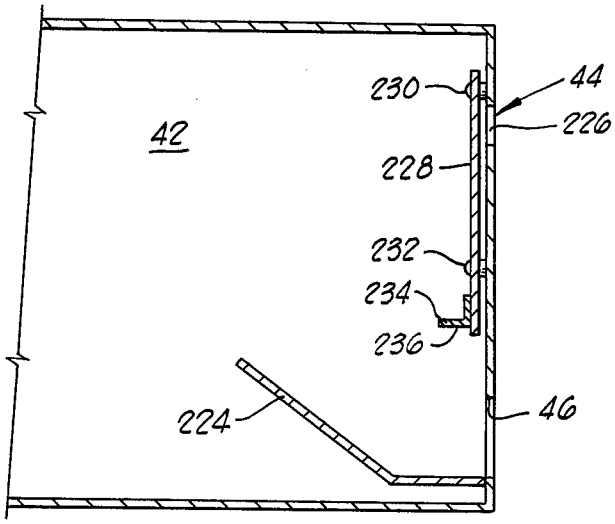
FIG. 16 is a sectional elevation view taken along lines 16—16 of FIG. 2, illustrating the components attached to the inside of the receipt vending means cover.

A chute 224, shown in dashed lines in FIG. 1 and in section in FIG. 16, is located directly below circular cut-out 126 of token dispensing mechanism 110, so that when token 109 falls through circular cut-out 126 the chute 224 guides the token 109 to the receipt dispensing opening 46.

The cover panel 42 for the receipt vending means 74, includes the compartment position indicating means 44 best illustrated in FIG. 16. Compartment position indicating means 44 includes a transparent window 226. Located behind window 226 is a sliding indicator plate 228 which reciprocates vertically upon screws 230 and 232 which are attached to cover panel 42 and protrude through vertical slots (not shown) in indicator plate 228. Attached to a lower end of indicator plate 228 is a sensing bracket 234. A lower surface 236 of sensing bracket 234 engages the top edge of horizontal arm 184 of primary member 180.

When the top cover 36 is locked in the closed position so that primary member 180 is rotated to its furthest clockwise position about pivot panel 186 as seen in FIG. 4, the indicator plate 228 is in its upwardmost position and a first indicia (not shown) printed on the front of indicator plate 228 is located directly behind window 226 so that the first indicia may be seen through window 226. The first indicia preferrably is the word "full", which indicates to the customer that there is a carton of bottles within the compartment 38 and that the customer may not at that time use the first carton receiving head 12. Such an indication will of course be given during the period of time that a carton 56 is being moved through the holding doors 60 and 62, and also when the carton storage section 16 behind first conveyor 18 becomes full so that the last carton 56 placed within compartment 38 cannot completely pass between holding doors 60 and 62, so that holding doors 60 and 62 remain open. The "full" sign will be maintained until such time as the carton storage section 16 is emptied.

In normal operation, before the carton storage section 16 is full, once the carton 56 passes through holding doors 60 and 62, the primary member 180 will be permitted to rotate counterclockwise, from the position of FIG. 4, thereby unlocking top cover 36, and also at the same time lowering sliding indicator plate 228 so that a second indicia (not shown) may show through window 226. The second indicia 228 preferrably comprises the word "receipt" which advises the customer that the compartment 38 of first carton receiving head 12 is ready to receive a carton of bottles.

Thus, the beverage container receiving and storing apparatus of the present invention is well adapted to carry out the objects and attain the ends and advantages mentioned, as well as those inherent therein. While presently preferred embodiments of the invention have been described for the purpose of this disclosure, numerous changes in the construction and arrangement of parts can be made by those skilled in the art, which changes are encompassed within the spirit of this invention as defined by the appended claims.

What is claimed is:

1. An apparatus for receiving and storing a carton of beverage containers, comprising:

a compartment for receiving said carton, said compartment including a cover means selectively movable between an open position and a closed position, so that when said cover means is in said open position said carton may be placed in said compartment;

a means for storing a plurality of said cartons;

a means for moving said carton from said compartment to said storing means, said moving means including a gravity operated conveyor; and a holding means, operatively associated with said cover means, for retaining said carton in said compartment when said cover means is in said open position, and for releasing said carton so that it may move down said gravity operated conveyor to said storing means when said cover means is in said closed position.

2. Apparatus of claim 1 further comprising:

a receipt vending means, operatively associated with said holding means, for vending a receipt when said carton is moved to said storing means.

3. An apparatus for receiving and storing an article comprising:

a compartment for receiving said article, said compartment including a cover means selectively movable between an open position and a closed position, so that when said cover means is in said open position said article may be placed in said compartment;

a means for storing a plurality of said articles;

a means for moving said article from said compartment to said storing means;

an actuator means for sensing the presence of said article in said compartment, said actuator means being in an actuated position when said article is present in said compartment and an unactuated position when said compartment is empty;

a holding means, operatively associated with said cover means, for retaining said article in said compartment when said cover means is in said open position and for releasing said article so that it may be moved to said storing means when said cover means is in said closed position; and a means, operatively associated with said actuator means and said holding means, for vending a receipt when said article is moved to said storing means, said receipt vending means including:

a token ejection means movable from a first position to a second position to eject said token;

means for moving said token ejecting means from said first position to an intermediate position, between said first and second positions, when said article is placed in said compartment;

means for moving said token ejecting means from said intermediate position to said second position to eject said token when said article passes through said holding means; and means for moving said token ejecting means back to said first position when said compartment is empty.

4. Apparatus of claim 3 wherein said means for moving said article comprises a gravity operated conveyor.

5. Apparatus of claim 4 wherein said actuator means includes resilient means for urging said article along said conveyor and out of said compartment.

6. Apparatus of claim 4 wherein said holding means comprises a holding door means spanning said conveyor between said compartment and said storing means, said holding door means being movable between a closed position whereby said article is retained in said compartment and an open position whereby said article is released so that it may be moved to said storing means.

7. Apparatus of claim 6 wherein said cover means is further characterized as being connected to a remainder of said compartment by a hinge and having a lip portion extending behind said hinge for engaging said holding door means and preventing said holding means from opening when said top cover means is in said open position.

8. Apparatus of claim 7 further comprising:

a first locking means, operatively associated with said cover means and said actuator means, for locking said cover means in said closed position when said actuator means is in said actuated position and remaining locked until said actuator means is returned to said unactuated position; and a second locking means, operatively associated with said cover means and said holding door means, for locking said holding door means in said closed position when said cover means is opened an amount sufficient to permit placement of said article is said compartment, and remaining locked until said cover means is closed an amount sufficient to lock said first locking means.

9. Apparatus of claim 3 further comprising:

a first locking means, operatively associated with said cover means and said actuator means, for locking said cover means in said closed position when said actuator means is in said actuated position and remaining locked until said actuator means is returned to said unactuated position; and a second locking means, operatively associated with said cover means and said holding door means, for locking said holding door means in said closed position when said cover means is opened an amount sufficient to permit placement of said article in said compartment, and remaining locked until said cover means is closed an amount sufficient to lock said first locking means.

10. Apparatus of claim 3 wherein:

said means for moving said article includes a gravity operated conveyor located below said actuator means;

said cover means is further characterized as being a top cover means located above said actuator means; and said actuator means includes an actuator panel projecting substantially horizontally into said compartment between said top cover means and said conveyor when said actuator means is in said unactuated position, and said actuator panel being pivoted to a substantially vertical actuated position when said article is placed within said compartment on said conveyor.

11. Apparatus of claim 10 wherein said actuator means further includes a resilient means for urging said actuator panel toward said unactuated position and urging said article against said holding means.

12. An article receiving apparatus, comprising:

a compartment for receiving said article, said compartment including a cover means selectively movable between an open position and a closed position, so that when said cover means is in said open position said article may be placed in said compartment;

an actuator means for sensing the presence of said article in said compartment;

a holding means for retaining said article in said compartment when said cover means is in said open position, and for releasing said article so that it may be moved from said compartment when said cover means is in said closed position;

a first locking means, operatively associated with said cover means and said actuator means, for locking said cover means in its said closed position when said cover means is closed with said article present in said compartment; and a second locking means, operatively associated with said cover means and said holding means, for preventing said holding means from releasing said article until said cover means is locked in its said closed position by said first locking means.

13. Apparatus of claim 12, further comprising an interlocking means, operatively associated with said first locking means and said holding means, for preventing said first locking means from unlocking said cover means, said cover means having been locked in its said closed position, until said article is moved out of engagement with said holding means.

14. Apparatus of claim 13, wherein said interlocking means comprises:

a swing arm, pivotally attached to a side of said compartment, said swing arm being operatively associated with said holding means so that said swing arm is pivoted when said article is moved from said compartment; and an interlock rod means, connected to said swing arm, for engaging said first locking means until said article is moved out of engagement with said holding means.

15. Apparatus of claim 13, wherein said first locking means comprises:

a primary member, pivotally attached to a side of said compartment, and including a first leg for engaging said cover means and a second leg for engaging said interlocking means, said primary member having a center of gravity oriented so that the force of gravity acting on said primary member urges it to pivot out of engagement with said cover means;

a secondary member, pivotally attached to said side of said compartment and being pivotable between a first position and a second position, said secondary member having a means for engaging said primary member so that when said secondary member is in said first position said primary member is held in a position for engagement with said cover means, said secondary member further including a means for engaging said actuating means to move said secondary member to its said second position allowing said primary member to release said cover means when said article is not present in said compartment; and spring means, connected to said secondary member for urging said secondary member into its said first position when said secondary member is not engaged with said actuating means.

16. An apparatus for receiving and storing a carton of beverage containers, comprising:

a compartment for receiving said carton, said compartment including a cover means selectively movable between an open position and a closed position, so that when said cover means is in said open position said carton may be placed in said compartment;

a means for storing a plurality of said cartons;

a means for moving said carton from said compartment to said storing means, said moving means including a gravity operated conveyor; and a holding means, operatively associated with said cover means, for retaining said carton in said compartment when said cover means is in said open position, and for releasing said carton so that it may move down said gravity operated conveyor to said storing means when said cover means is in said closed position;

wherein said moving means further includes a means for initially urging said carton toward said storing means when said carton is released by said holding means.

* * * * *